US005596396A

United States Patent [19]

Landa et al.

[11] Patent Number: 5,596,396

[45] **Date of Patent: *Jan. 21, 1997**

[54] LATENT IMAGE DEVELOPMENT APPARATUS

[75] Inventors: Benzion Landa, Edmonton, Canada; Ishaiau Lior, Nes Ziona; Ehud Chatow, Petach Tikva, both of Israel

[73] Assignee: Indigo N.V., Veldhoven, Netherlands

[ * ] Notice: The term of this patent shall not extend beyond the expiration date of Pat. No. 5,436,706.

[21] Appl. No.: 434,236

[22] Filed: May 4, 1995

Related U.S. Application Data

[63] Continuation of Ser. No. 170,347, filed as PCT/NL91/00243, Nov. 29, 1991 published as WO93/01531, Jan. 21, 1993, Pat. No. 5,436,706, which is a continuation-in-part of Ser. No. 727,599, Jul. 9, 1991, abandoned.

[51] Int. Cl.[6] ..... G03G 15/10

[52] U.S. Cl. ..... 399/237; 430/117; 399/302

[58] Field of Search ..... 355/256, 267, 355/268; 118/651, 659, 660, 661; 430/100, 117

[56] References Cited

U.S. PATENT DOCUMENTS

| | | | |
|---|---|---|---|
| 3,758,204 | 9/1973 | Mochizuki . | |
| 3,814,054 | 6/1974 | Tajihi . | |
| 3,863,603 | 2/1975 | Buckley et al. . | |
| 3,959,574 | 5/1976 | Seanor et al. . | |
| 3,973,699 | 8/1976 | Cook . | |
| 4,083,326 | 4/1978 | Kroll et al. . | |
| 4,089,733 | 5/1978 | Zimmerman . | |
| 4,271,785 | 6/1981 | Dinallo, Sr. et al. . | |
| 4,286,039 | 8/1981 | Landa et al. . | |
| 4,307,168 | 12/1981 | Letental et al. . | |
| 4,325,627 | 4/1982 | Swidler et al. . | |
| 4,504,138 | 3/1985 | Kuehnle et al. . | |
| 4,607,940 | 8/1986 | Quang . | |
| 4,684,238 | 8/1987 | Till et al. . | |
| 4,732,786 | 3/1988 | Patterson et al. . | |
| 4,761,357 | 8/1988 | Tavernier et al. . | |
| 4,794,651 | 12/1988 | Landa et al. . | |
| 4,833,500 | 5/1989 | Mochizuki et al. . | |
| 4,974,027 | 11/1990 | Lanada et al. . | |
| 4,985,733 | 1/1991 | Kurotori et al. . | |
| 4,992,832 | 2/1991 | Watanabe et al. . | |
| 5,034,778 | 7/1991 | Levanon et al. . | |
| 5,387,760 | 2/1995 | Miyazawa et al. | 118/661 |
| 5,436,706 | 7/1995 | Landa et al. | 355/256 |

FOREIGN PATENT DOCUMENTS

| | | |
|---|---|---|
| 990589 | 3/1972 | Canada . |
| 0226750 | 7/1987 | European Pat. Off. . |
| 0306217 | 3/1989 | European Pat. Off. . |
| 0481516 | 4/1992 | European Pat. Off. . |
| 9004216 | 4/1990 | WIPO . |
| 9010896 | 9/1990 | WIPO . |

OTHER PUBLICATIONS

*Xerox Disclosure Journal*, vol. 11, No. 6, Nov./Dec. 1986, "Leak Free Developer Module", Monkelbaan, E. et al., pp. 305–306.

*Primary Examiner*—Joan H. Pendegrass
*Attorney, Agent, or Firm*—Greenblum & Bernstein P.L.C.

[57] ABSTRACT

Imaging apparatus including a first member having a first surface having formed thereon a latent electrostatic image, the latent electrostatic image including image regions at a first voltage and background regions at a second voltage, a second member charged to a third voltage intermediate the first and second voltages and having a second surface adapted for resilient engagement with the first surface and a third member adapted for resilient contact with the second surface in a transfer region. The imaging apparatus also includes apparatus for supplying liquid toner to the transfer region thereby forming on the second surface a thin layer of liquid toner containing a relatively high concentration of charged toner particles and apparatus for developing the latent image by the selective transfer of portions of the layer of liquid toner from the second surface to the first surface.

34 Claims, 15 Drawing Sheets

LATENT IMAGE DEVELOPMENT APPARATUS

RELATED APPLICATIONS

This application is a continuation of U.S. patent application Ser. No. 08/170,347, filed Feb. 3, 1994, now U.S. Pat. No. 5,436,706 which is the national stage application of PCT application PCT/NL91/00243, filed Nov. 29, 1991 which is a continuation in part of U.S. patent application Ser. No. 07/727,599, filed Jul. 9, 1991, now abandoned.

FIELD OF THE INVENTION

The present invention relates generally to development apparatus and more particularly to latent image development apparatus in electrophotographic imaging systems.

BACKGROUND OF THE INVENTION

The method of developing a latent image formed on a photoconductive surface by means of electrophoretic transfer of liquid toner is well known in the art. In this method, charged particles suspended in a non-polar insulating carrier liquid migrate under the influence of an electrostatic field and concentrate in image forming configuration upon relatively charged or discharged areas of a photoconductive surface. The latent image so developed is then transferred to a substrate, such as paper, either directly or by means of one or more intermediate transfer members.

In U.S. Pat. No. 4,504,138 a different method for the developing of a latent image is described. The method described involves applying a thin viscous high density layer of toner particles on the circumferential surface of a roller and bringing the layer so formed to the photoconductive surface. Transfer of selected portions of the toner layer onto the photoconductive surface then occurs as a function of the electric field strength of the latent image.

In Canadian Patent 990589, a method of developing electrostatic images is described which involves producing a film of liquid toner on a first applicator and bringing the applicator in contact with the final substrate which carries a latent image, thereby to develop the image. A second applicator bearing a layer of carrier liquid is then brought into contact with the substrate to remove background deposits and to squeegee out excess liquid. The film of liquid toner described in Canadian Patent 990589 has between 2–4 percent of toner concentrate dispersed within the carrier liquid.

SUMMARY OF THE INVENTION

It is the object of the present invention to provide simplified apparatus for the development of latent images in electrophotographic imaging systems by the direct transfer of concentrated liquid toner. There is therefore provided imaging apparatus including:

a first member having a first surface having formed thereon a latent electrostatic image, the latent electrostatic image including image regions at a first voltage and background regions at a second voltage;

a second member charged to a third voltage intermediate the first and second voltages and having a second surface adapted for resilient engagement with the first surface at a first, transfer, region;

a third member resiliently urged against the second surface at a second region;

means for supplying liquid toner comprising charged toner particles and carrier liquid to the second region, thereby forming on the second surface a thin layer of liquid toner containing a relatively high concentration of charged toner particles;

means for developing the latent image by the selective transfer of portions of the layer of liquid toner from the second surface to the first surface at the first region to form a developed image on the first member; and means for transferring the developed image from the first member to a final substrate.

There is further provided in a preferred embodiment of the invention imaging apparatus including:

a first member including a first surface having formed thereon a latent electrostatic image, the latent electrostatic image having image regions at a first voltage and background regions at a second voltage;

a second member charged to a third voltage intermediate the first and second voltages and having a second surface adapted for resilient engagement with the first surface;

a third member adapted for depositing on the surface of the second member a thin layer of liquid toner containing a relatively high concentration of charged toner particles;

means for obtaining a desired image by selectively transferring portions of the layer of liquid toner from the surface of the second member to the photoconductive surface of the first member, the portions remaining on the surface of the second member constituting the desired image; and means for transferring the desired image to a final substrate.

Either or both of the first and second surfaces are preferably formed of resilient material.

In one preferred embodiment of the invention the third member is a roller with an elastomer surface, in another it is a resilient blade. In a third preferred embodiment the third member is a spring-mounted wire-wrapped solid rod. Alternatively the third member is an extrusion coating head.

Alternatively, in a preferred embodiment of the invention, the third member includes a metallic-screen hollow drum containing liquid toner and a squeegee blade urged against the inner surface of the metallic-screen, preferably also including a doctor blade in engagement with the second surface. Preferably the metallic-screen hollow drum, containing liquid toner, and a squeegee blade form a single disposable unit.

Preferably the third member is an integral component of the apparatus for supplying liquid toner.

In a preferred embodiment of the invention, the liquid toner supplied to the first transfer region includes toner particles at a concentration comparable to that of the thin layer.

In a preferred embodiment of the invention the thickness of the thin layer is between 5 and 15 micrometers.

In an especially preferred embodiment of the invention the layer of liquid toner is crumbly in texture and almost dry to the touch. Generally such a layer has a solids concentration of more than 50 percent and a thickness of between 2 and 8 micrometers.

There is further provided, in a preferred embodiment of the invention, imaging apparatus including:

a first member including a first surface having formed thereon a latent electrostatic image, the latent electrostatic image having image regions at a first voltage and background regions at a second voltage;

a second member having a second surface and being charged to a third voltage intermediate the first and second voltages;

means for resiliently urging the second surface against the first surface at an interface region;

means for supplying to the interface region liquid toner comprising a high concentration of charged toner particles in a carrier liquid, whereby the latent image is developed as the liquid toner is extruded between the first and second members; and means for transferring the developed toner image from the first surface to a final substrate.

There is further provided, in a preferred embodiment of the invention, a liquid toner developer cartridge, comprising:

a housing;

a quantity of liquid toner concentrate within the housing, the liquid toner concentrate having a first concentration of solids to liquid; and means for dispensing a thin layer of liquid toner concentrate from the housing, whereby the thin layer has a second concentration of solids to liquid which is greater than the first concentration, The first concentration is preferably at a concentration of greater than 25 percent and the second concentration is crumbly in texture and almost dry to the touch and has a solids concentration of greater than 40 percent, desirably more than 50 percent.

In a preferred embodiment of the invention, the means for dispensing includes at least two rollers, the first roller having a resilient surface and the second roller having a solid surface. Preferably the two rollers are electrified to different electrical potentials.

Preferably, the cartridge includes means for preventing dilution of the quantity of liquid toner concentrate remaining in the housing after the thin layer of toner concentrate has been dispensed therefrom, preferably including capillary means for drawing off excess liquid and a reservoir containing absorbent material for storing the excess liquid.

In a preferred embodiment of the invention, a portion of the dispensed layer is not removed from the cartridge and the cartridge includes means for reclaiming and dispersing the unremoved portion.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS

Figure 1:
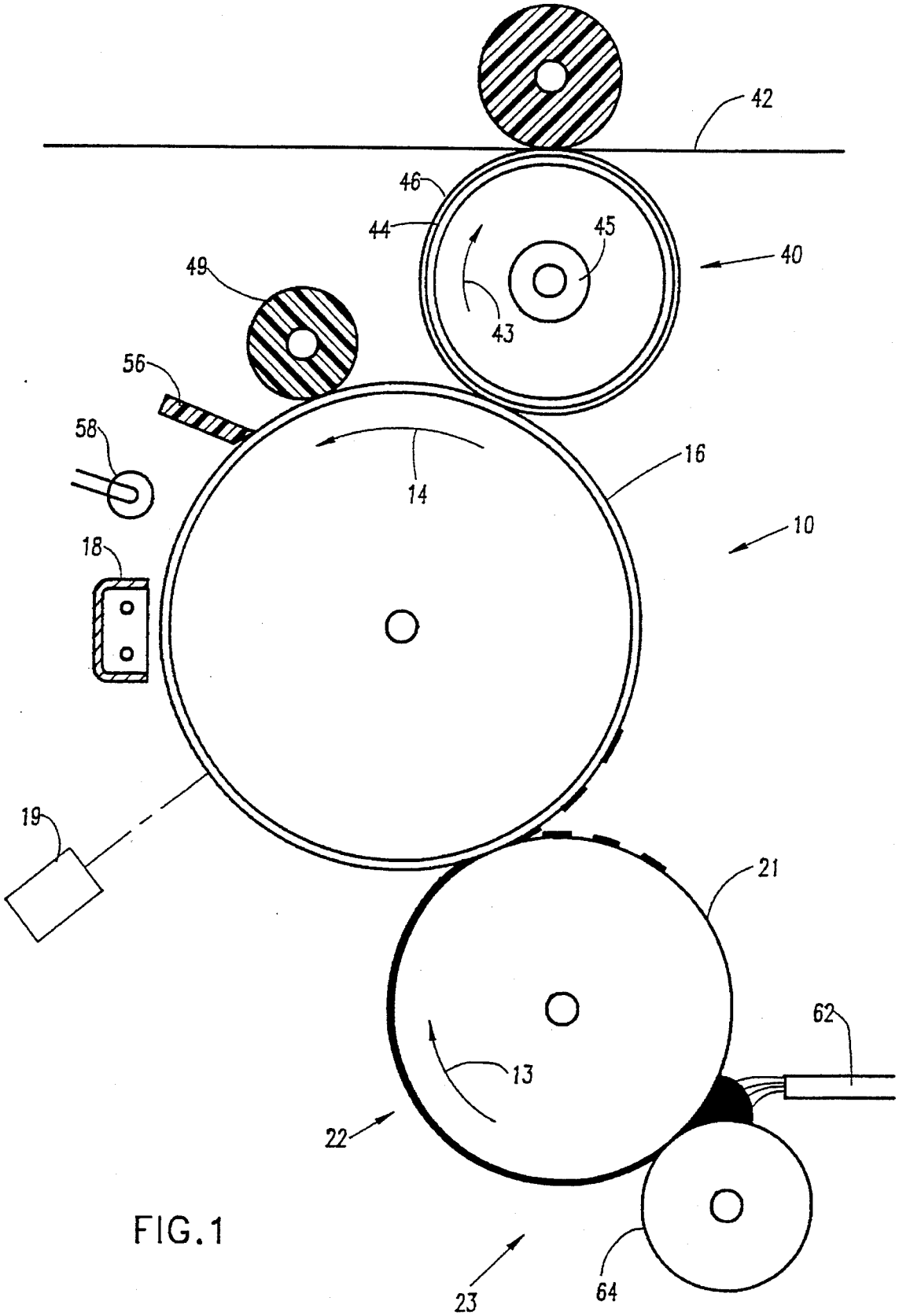
FIG. 1 is a schematic diagram of imaging apparatus constructed and operated in accordance with a preferred embodiment of the present invention.

Reference is now made to FIG. 1 which illustrates imaging apparatus constructed and operative in accordance with a preferred embodiment of the present invention.

The apparatus of FIG. 1 comprises a drum 10 arranged for rotation in a direction generally indicated by arrow 14. Drum 10 preferably has a cylindrical photoconductive surface 16 made of selenium, a selenium compound, an organic photoconductor or any other suitable photoconductor known in the art.

When the apparatus is operated, drum 10 rotates and photoconductive surface 16 is charged by a charger 18 to a generally uniformly pre-determined voltage, typically on the order of 1000 volts. Charger 18 may be any type of charger known in the art, such as a corotron, a scorotron or a roller.

Continued rotation of drum 10 brings charged photoconductive surface 16 into image receiving relationship with an exposure means such as a light source 19, which may be a laser scanner (in the case of a printer) or the projection of an original (in the case of a photocopier). Light source 19 forms a desired latent image on charged photoconductive surface 16 by selectively discharging a portion of the photoconductive surface, the image portions being at a first voltage and the background portions at a second voltage. The discharged portions preferably have a voltage of less than about 100 volts.

Continued rotation of drum 10 brings charged photoconductive surface 16, bearing the electrostatic latent image, into operative engagement with the surface 21 of a developer roller 22 which is part of developer assembly 23, more fully described below with reference to FIGS. 3A through 3H. Developer roller 22 rotates in a direction opposite that of drum 10, as shown by arrow 13, such that there is substantially zero relative motion between their respective surfaces at the point of contact. Surface 21 of developer roller 22 is preferably composed of a soft polyurethane material, preferably made more electrically conductive by the inclusion of conducting additives, while developer roller 22 may be composed of any suitable electrically conductive material. Alternatively, drum 10 may be formed of a relatively resilient material, and in such case surface 21 of developer roller 22 may be composed of either a rigid or a compliant material.

As described below, surface 21 is coated with a very thin layer of concentrated paste of liquid toner, preferably containing 15–35% charged toner particles, desirably more than 25% solids. The layer is preferably between 5 and 30 μm, more preferably between 5 and 15 μm, thick. Developer roller 22 itself is charged to a voltage that is intermediate the voltage of the charged and discharged areas on photoconductive surface 16.

In a preferred embodiment of the invention, a concentrated form of liquid toner such as the toner described in Example 1 of U.S. Pat. No. 4,794,651, the disclosure of which is incorporated herein by reference, is used although other types of toner are usable in the invention. For colored toners the carbon black in the preferred toner is replaced by colored pigments as is well known in the art.

When surface 21 of developer roller 22 bearing the layer of liquid toner concentrate is engaged with photoconductive surface 16 of drum 10, the difference in voltages between developer roller 22 and photoconductive surface 16 causes the selective transfer of the layer of toner particles to photoconductive surface 16, thereby developing the desired latent image. Depending on the choice of toner charge polarity and the use of a "write-white" or "write-black" system, the layer of toner particles will be selectively attracted to either the charged or discharged areas of photoconductive surface 16, and the remaining portions of the toner layer will continue to adhere to surface 21 of developer roller 22.

Because the transfer of the concentrated layer of toner is much less mobility dependent than in normal electrophoretic development, the process described above occurs at a relatively high speed. Also, since the layer already has a high density and viscosity, there is no need to provide for metering devices, rigidizing rollers and the like which would otherwise be necessary to remove excess liquid from the developed image to attain the desired density of toner particles of the developed image.

Figure 2:
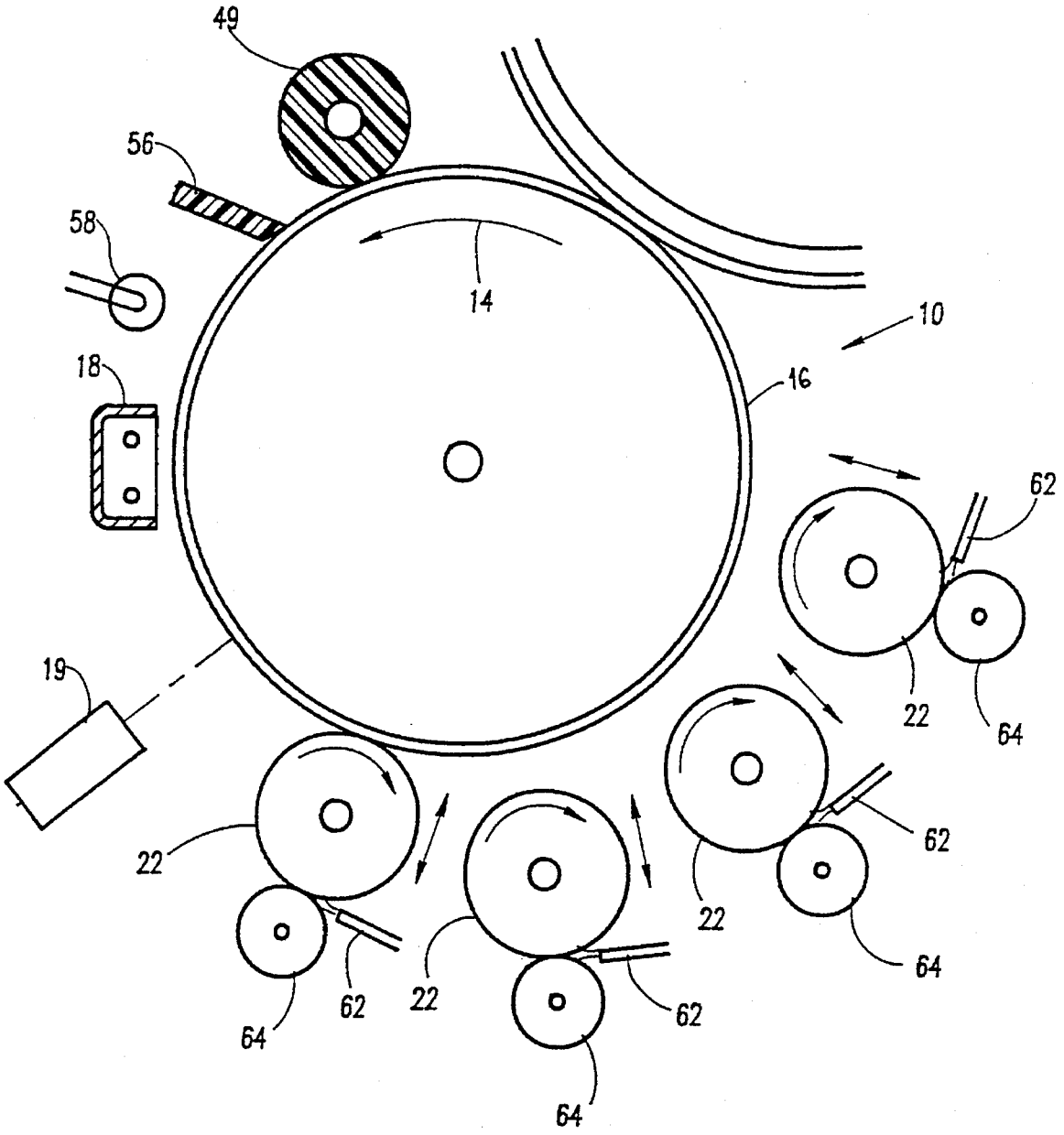
FIG. 2 is a schematic diagram of a multi-color imaging apparatus in accordance with a preferred embodiment of the present invention.

For multicolor systems, as shown in FIG. 2, a plurality of developer rollers may be provided, one for each color, which are sequentially engaged with photoconductive surface 16 to develop sequentially produced latent images.

The latent image developed by means of the process described above is then directly transferred to a desired substrate in a manner well known in the art. Alternatively, as shown in FIG. 1, there may be provided an intermediate transfer member 40, which may be a drum or belt and which is in operative engagement with photoconductive surface 16 of drum 10 bearing the developed image. Intermediate transfer member 40 rotates in a direction opposite to that of photoconductive surface 16, as shown by arrow 43, providing substantially zero relative motion between their respective surfaces at the point of image transfer. Intermediate transfer member 40 is operative for receiving the toner image from photoconductive surface 16 and for transferring the toner image to a final substrate 42, such as paper. Disposed internally of intermediate transfer member 40 there may be provided a heater 45, to heat intermediate transfer member 40 as is known in the art. Transfer of the image to intermediate transfer member 40 is preferably aided by providing electrification of intermediate transfer member 40 to provide an electric field between intermediate transfer member 40 and the image areas of photoconductive surface 16. Intermediate transfer member 40 preferably has a conducting layer 44 underlying an elastomer layer 46, which is preferably a slightly conductive resilient polymeric layer.

Various types of intermediate transfer members are known and are described, for example in U.S. Pat. No. 4,684,238, PCT Publication WO 90/04216 and U.S. Pat. No. 4,974,027, the disclosures of all of which are incorporated herein by reference.

Following the transfer of the toner image to substrate 42 or to intermediate transfer member 40, photoconductive surface 16 engages a cleaning station 49, which may be any conventional cleaning station. Scraper 56 completes the removal of any residual toner which may not have been removed by cleaning station 49. A lamp 58 then completes the cycle by removing any residual charge, characteristic of the previous image, from photoconductive surface 16.

Figure 3A:
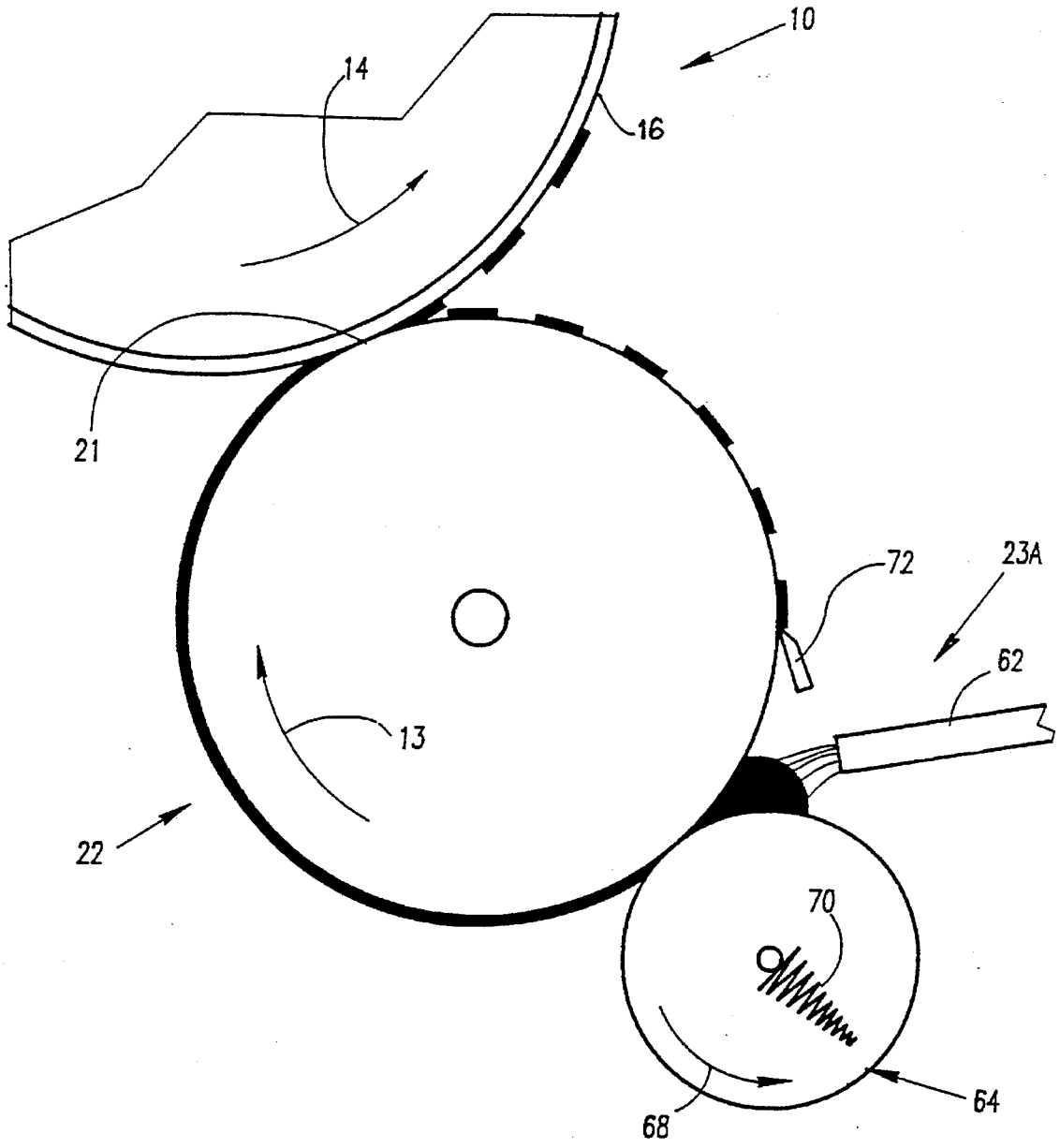
FIG. 3A is a more detailed schematic diagram of a developer assembly constructed and operated in accordance with a preferred embodiment of the present invention.

It is to be understood that, in a preferred embodiment of the invention, the liquid toner concentrate which is transferred to drum 10 has substantially the same toner particle concentration as the image when it is transferred from drum 10. This is in contrast to traditional liquid development where the liquid developer has a comparatively low concentration of particles before development and where excess liquid is removed from the image before transfer from the photoconductor. It is also in contrast to U.S. Pat. No. 4,504,138, in which the toner supplied to the drum (and which is transferred to the drum) is more concentrated, but where excess liquid must still be removed from the image before transfer to the final substrate. In a preferred embodiment of the present invention, the starting toning material is at a solids concentration substantially equal to that of the image transferred from the drum. The toning material may be further concentrated before contact with drum 10 or mechanical squeegeeing may be used to further increase the concentration during the process of transfer of toner to the drum. Reference is now made to FIG. 3A which shows the construction and operation of a preferred developer assembly 23A. Developer assembly 23A comprises a toner dispenser 62 which dispenses liquid toner concentrate onto the surface of a roller 64 arranged for rotation in a direction indicated by arrow 68. Roller 64 is preferably formed of metal and roller 21 is formed of a metal core having a covering of an elastomer material, which is preferably a slightly conductive resilient polymeric material, as described for example, in U.S. Pat. No. 3,959,574 or U.S. Pat. No. 3,863,603. Roller 64 may have a very thin coating of polymer material. As it rotates, roller 64 is resiliently urged against surface 21 of developer roller 22, by virtue of a spring 70, and a thin layer of liquid toner concentrate is formed on surface 21 of developer roller 22. The thickness of the layer is a function of the pressure applied and the hardness of the surfaces.

Roller 64 may also be electrified by a D.C. source to avoid deposition of toner concentrate on roller 64. It may further or alternatively be connected to an AC source, which is operative to reduce somewhat the viscosity of the toner concentrate and generally to cause the deposition of a smoother layer on surface 21 of developer roller 22.

In a preferred embodiment of the invention, the liquid toner is supplied at a pre-determined concentration, equal to the concentration of toner particles necessary for the desired optical density of the final image. Supply of the liquid toner concentrate at the pre-determined concentration obviates the need for pumps, tanks, sensors and other costly apparatus which would otherwise be needed in the event a dilute solution of liquid concentrate is provided.

In an alternative embodiment, the liquid toner is supplied at a concentration less than that required for optimal development of the latent image. In such event, roller 64 may also function as a mechanical and electrical "squeegee" roller, i.e. when urged against surface 21 of developer roller 22, it mechanically removes excess toner fluid from the layer impressed on surface 21, and when charged with a suitable electric potential, it repels the charged toner particles and causes them to more closely adhere to surface 21. The excess fluid which has been removed is recovered for reuse. Applicants have found that the solids content of the layer is mainly a function of the mechanical properties of the rollers and of the applied voltages and pressures and is only slightly influenced by the initial concentration for a considerable range of initial toner concentrations.

As described above, the layer of liquid toner which is deposited by means of roller 64 on surface 21 is selectively transferred to photoconductive surface 16 in the process of developing the latent image. In principle, the system described above does not require that the portions of the toner layer that have not been used in the development of the latent image be removed from developer roller 22 between cycles. However, in the event the toner is of a type which becomes discharged by the electric fields in the interface between the surfaces of developer roller 22 and drum 10, a cleaning station 72 may be provided, which may comprise a brush or comb or similar apparatus, to remove the excess toner concentrate from surface 21 of developer roller 22. The toner so removed may then be pumped back for reuse after mixture with fresh toner, or may be mixed with the toner being fed into the nip between developer roller 22 and roller 64.

Figure 3B:
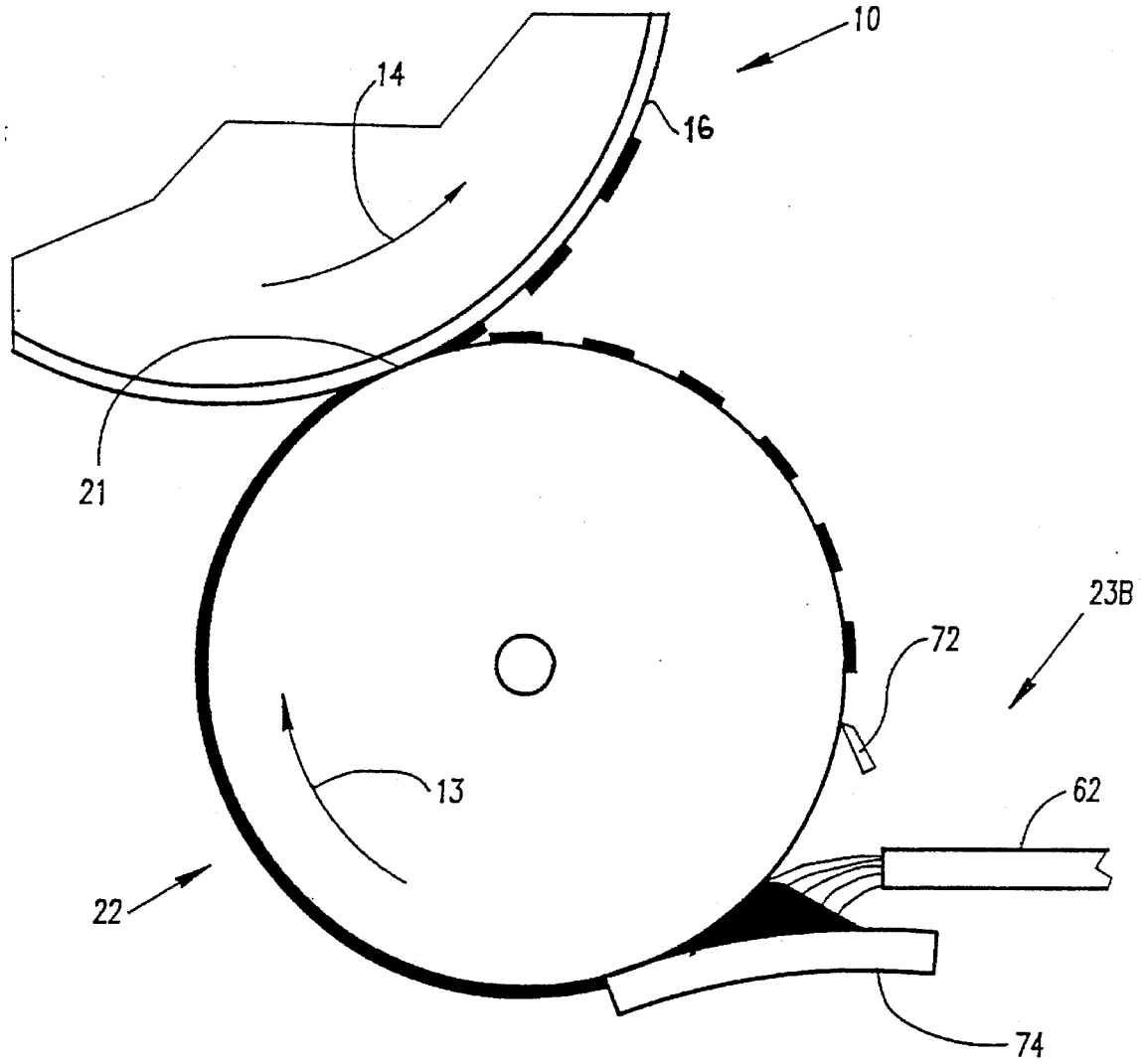
FIGS. 3B, 3C, 3D, 3E, 3F, 3G and 3H are schematic diagrams of alternative embodiments of developer assemblies constructed and operated according to the present invention.

Reference is now made to FIGS. 3B through, 3H, which show alternate embodiments 23B through 23H, of developer assembly 23 in accordance with the invention. FIGS. 3B through 3H are identical to FIG. 3A, except that in each case roller 64 has been replaced by a different structure capable of supplying a thin layer of viscous toner concentrate on developer roller 22.

In FIG. 3B, roller 64 is replaced by a resilient blade 74, which may be composed of the same material as roller 64 and which is preferably electrically biased to cause better adhesion of the toner particles to surface 21 and better release from blade 74.

Figure 3C:
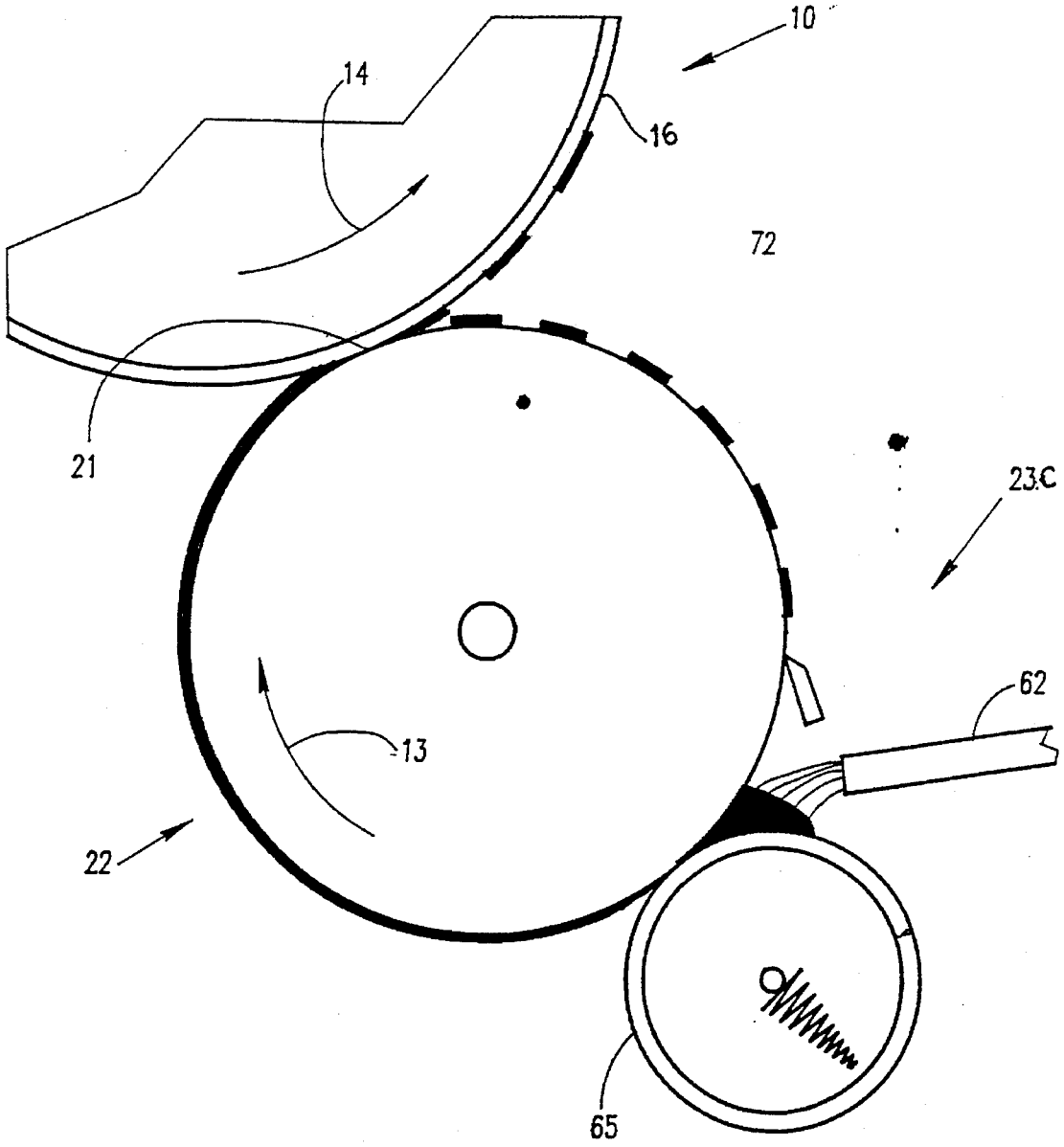

In FIG. 3C, roller 64 is replaced by a spring-mounted wire-wrapped solid rod 65, and the coating of surface 21 is accomplished by a "wire-rod" process as is well known in the art. Rod 65 may also be electrically biased.

Figure 3D:
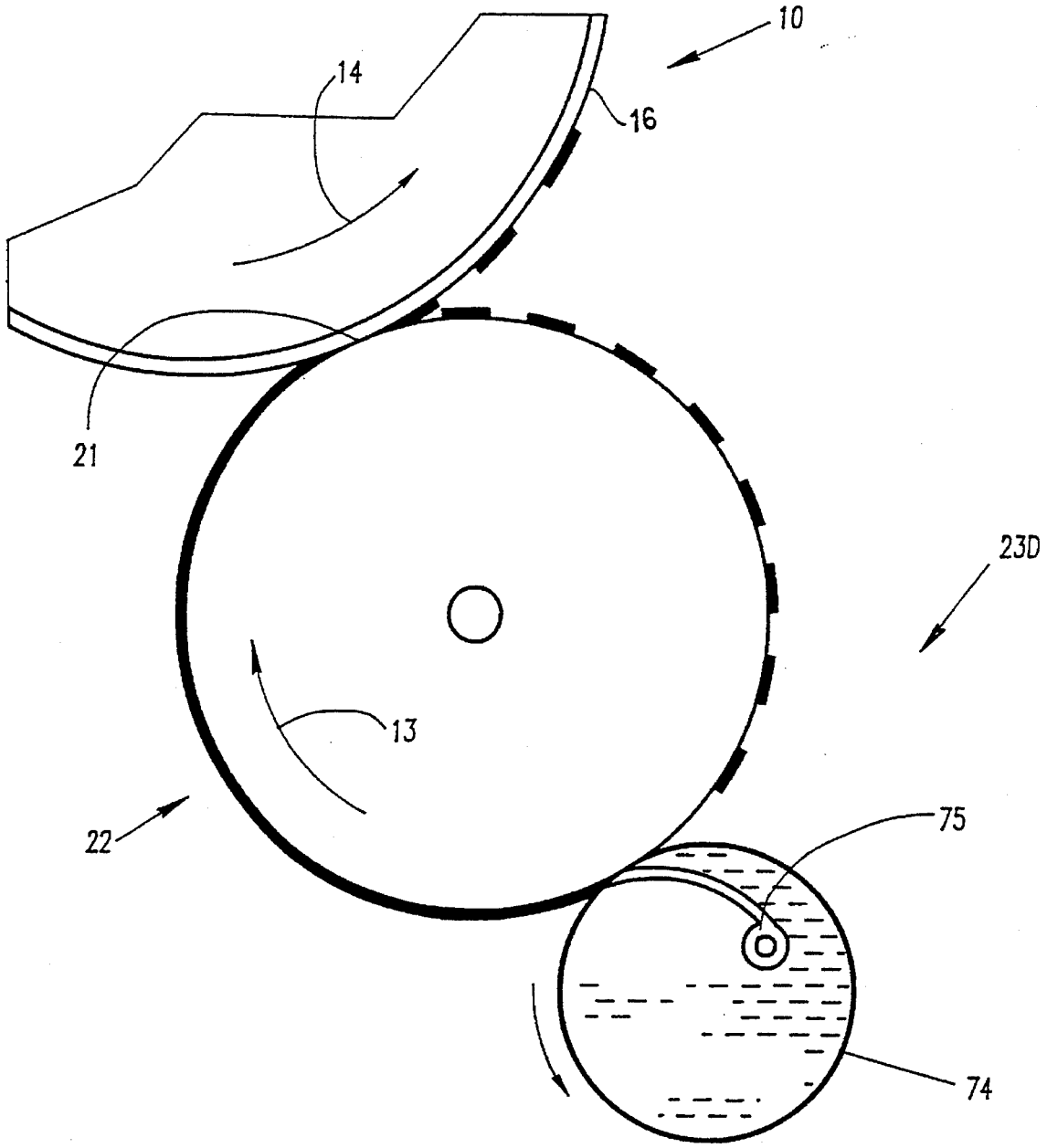

In FIG. 3D, roller 64 is replaced by a metallic-screen drum 74 in which a squeegee blade 75 is mounted and which is urged against the inner surface of the metallic screen 74 near its point of contact with developer roller 22. Liquid toner concentrate is supplied to the inside of drum 74 and is deposited on surface 21 through the screen when drum 74 is rotated together with roller 22. In a preferred embodiment, the metallic-screen drum together with the squeegee blade and a supply of liquid toner concentrate are supplied as a disposable unit which is replaced when the toner material is depleted.

Figure 3E:
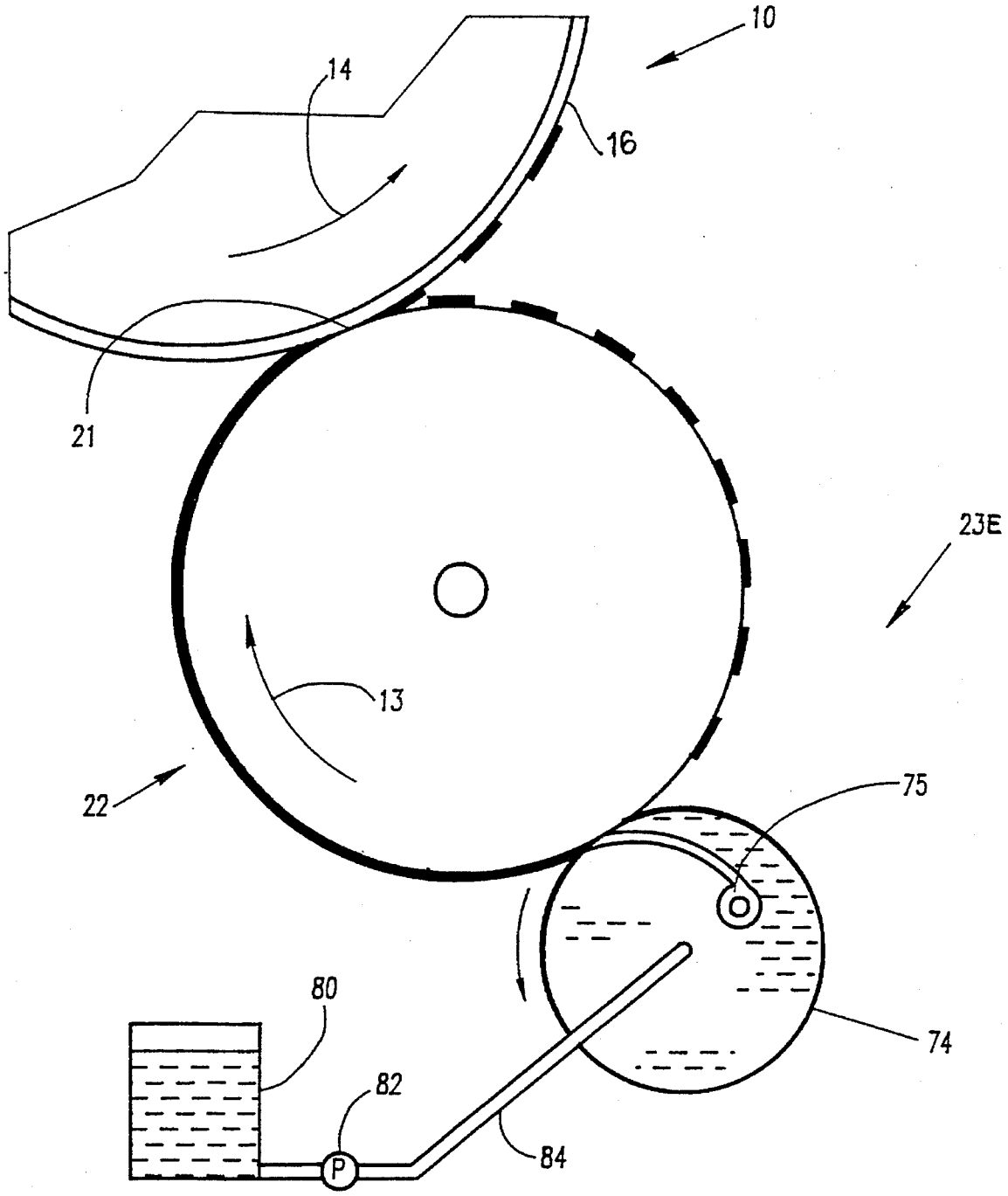

FIG. 3E shows a preferred alternative to the disposable unit described. In the embodiment shown in FIG. 3E, toner concentrate is fed to metallic-screen drum 74 from a reservoir 80 by pump 82 via conduit 84. The pressure of the toner concentrate in drum 74 is kept substantially constant by pump 82. This pressure is not sufficient to force the toner concentrate through the screen over most of its surface. However during rotation of drum 74 the tip of squeegee blade 75 increases the pressure sufficiently to force the concentrate through the holes to coat roller 22.

Figure 3F:
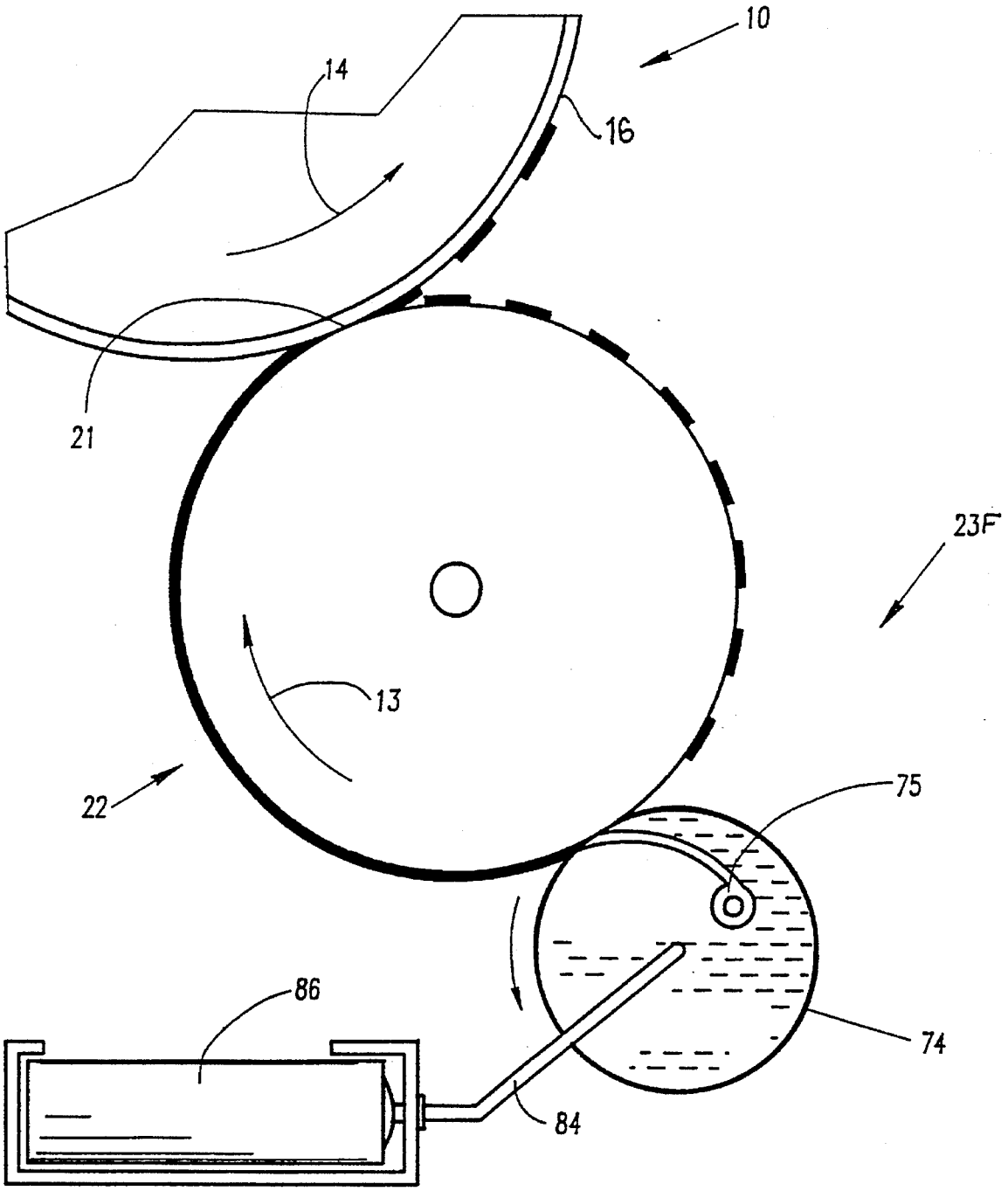

Alternatively, as shown in FIG. 3F, a replaceable pressurized container 86 of toner concentrate replaces reservoir 80 and pump 82. In the embodiments of FIG. 3E and 3F, drum 74 is preferably not removed when the toner is replenished.

Figure 3G:
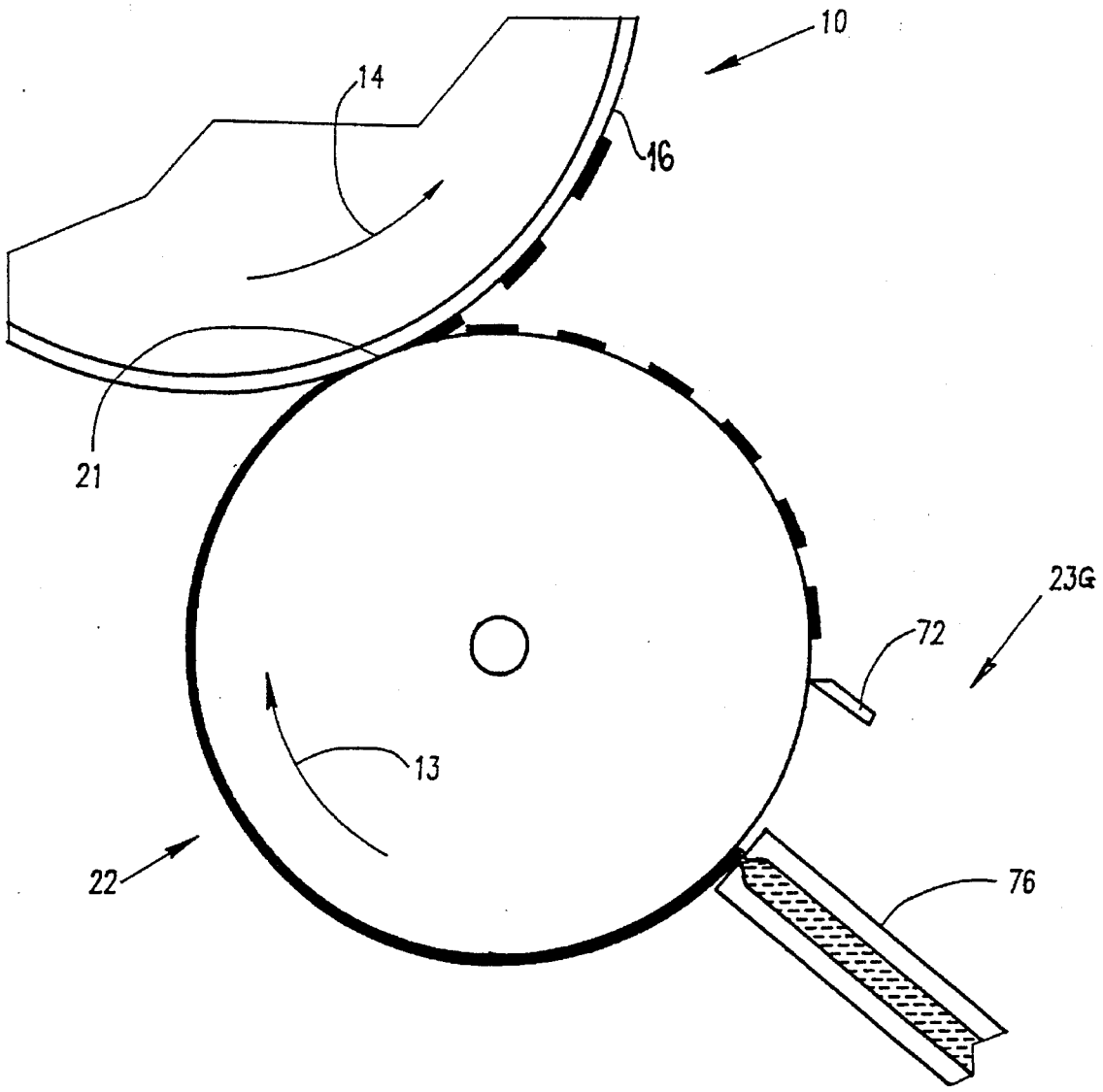

In FIG. 3G, roller 64 is replaced by an extrusion coating head 76, which dispenses the liquid toner concentrate in a layer upon surface 21 of developer roller 22.

Figure 3H:
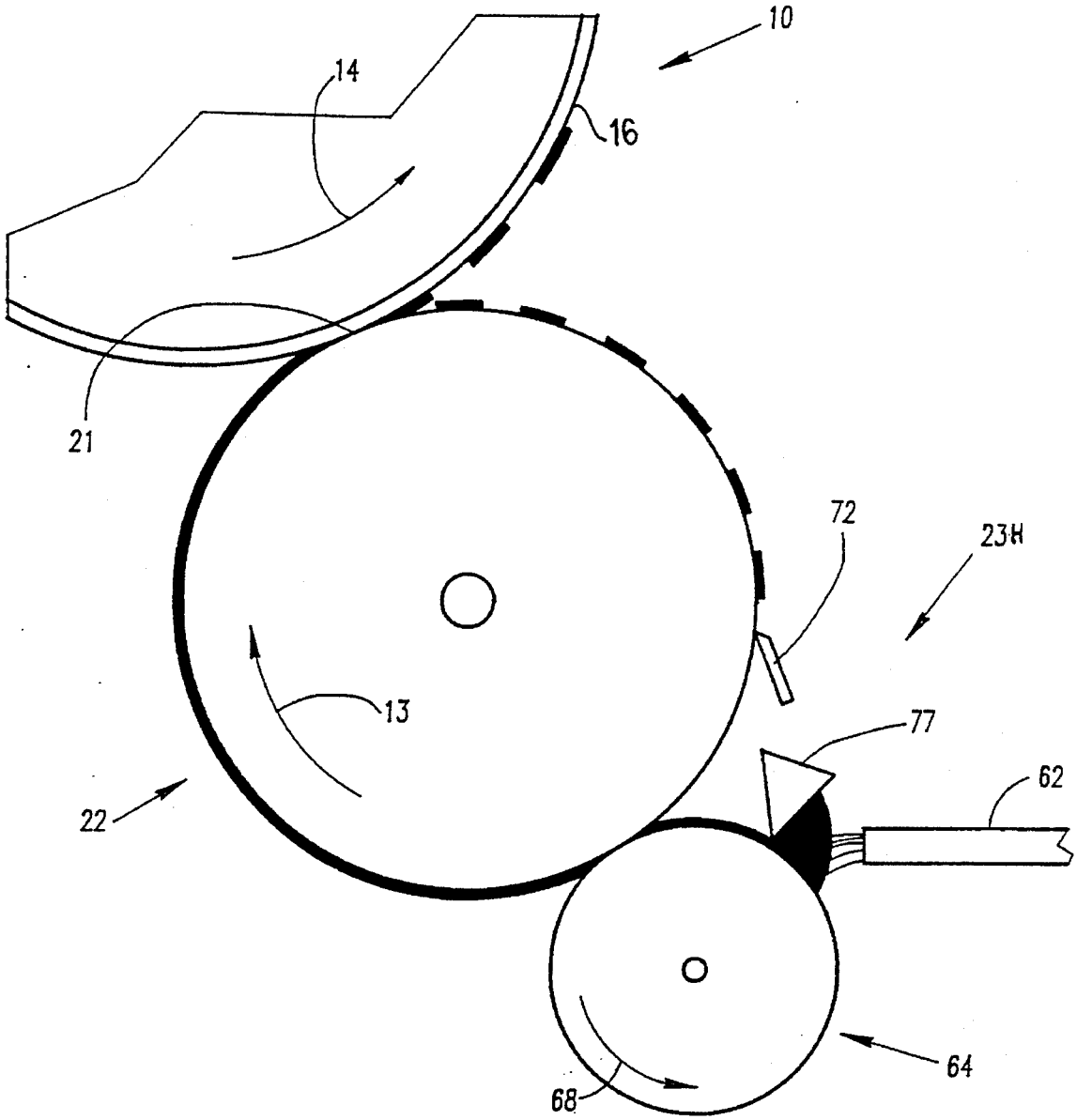

FIG. 3H shows an alternative embodiment of the developer assembly in accordance with the invention. The apparatus of FIG. 3H is similar to that of FIG. 3A, except that the liquid toner concentrate is supplied to the interface between the surface of roller 64 and a doctor blade 77. A thin layer of the toner concentrate is formed on the surface of roller 64 which is then transferred in the manner described above.

Figure 4:
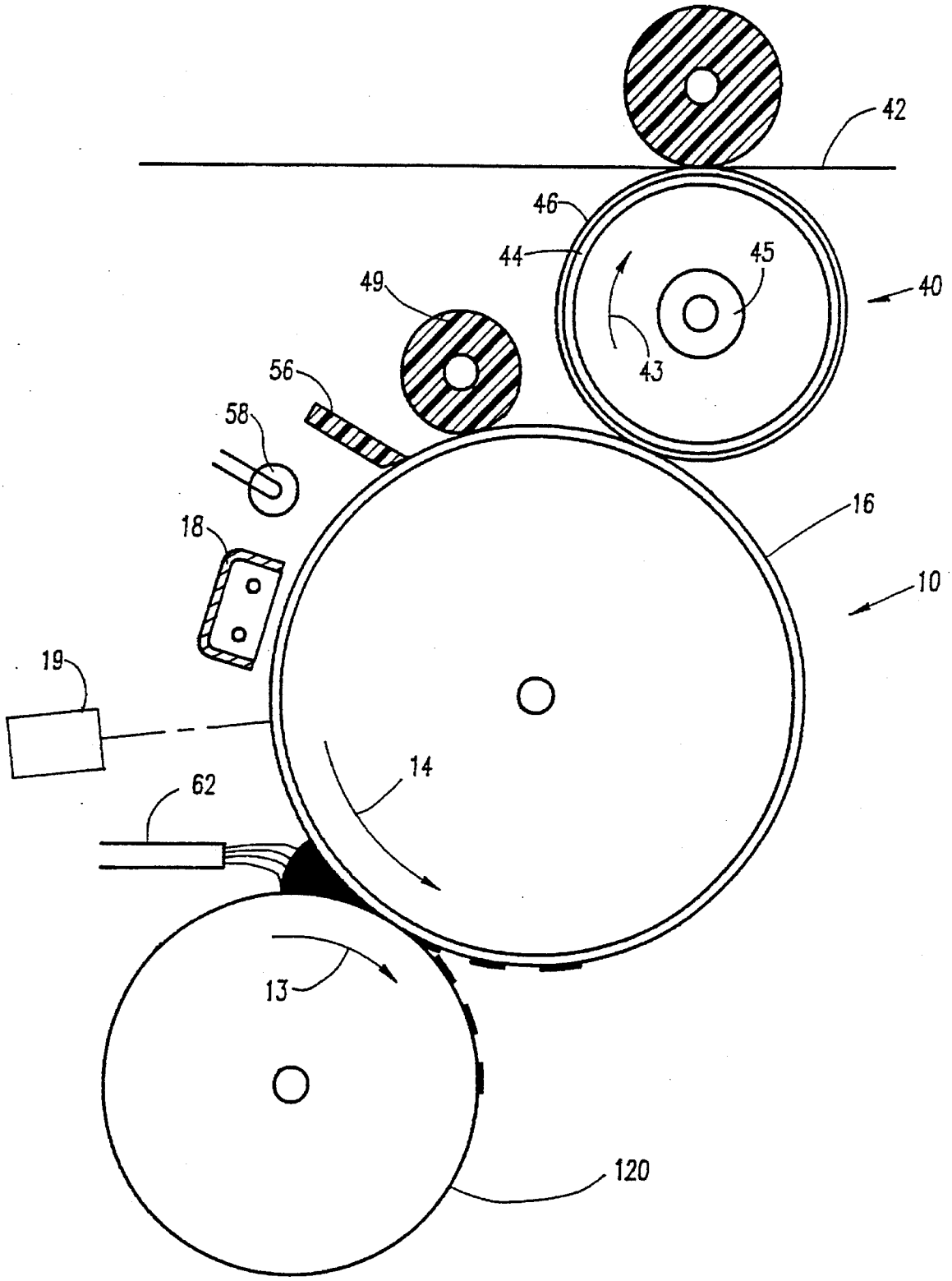
FIG. 4 is a schematic diagram of an additional preferred embodiment of the present invention.

Reference is made to FIG. 4 which shows a cross-sectional schematic view of an alternative embodiment of the invention in which concentrated liquid toner is supplied to an interface between a squeegee roller 120 and drum 10 bearing a latent image. As in the previous embodiments roller 120 and drum 10 are mechanically resiliently urged together. The embodiment of FIG. 4 differs from the other embodiments in that a thin layer of concentrated material is formed by extrusion between the squeegee roller and the drum as they roll together and are urged against each other. As seen in FIG. 4 the thin layer immediately separates into image portions which remain on drum 10, and background portions which remain on roller 120.

Figure 5:
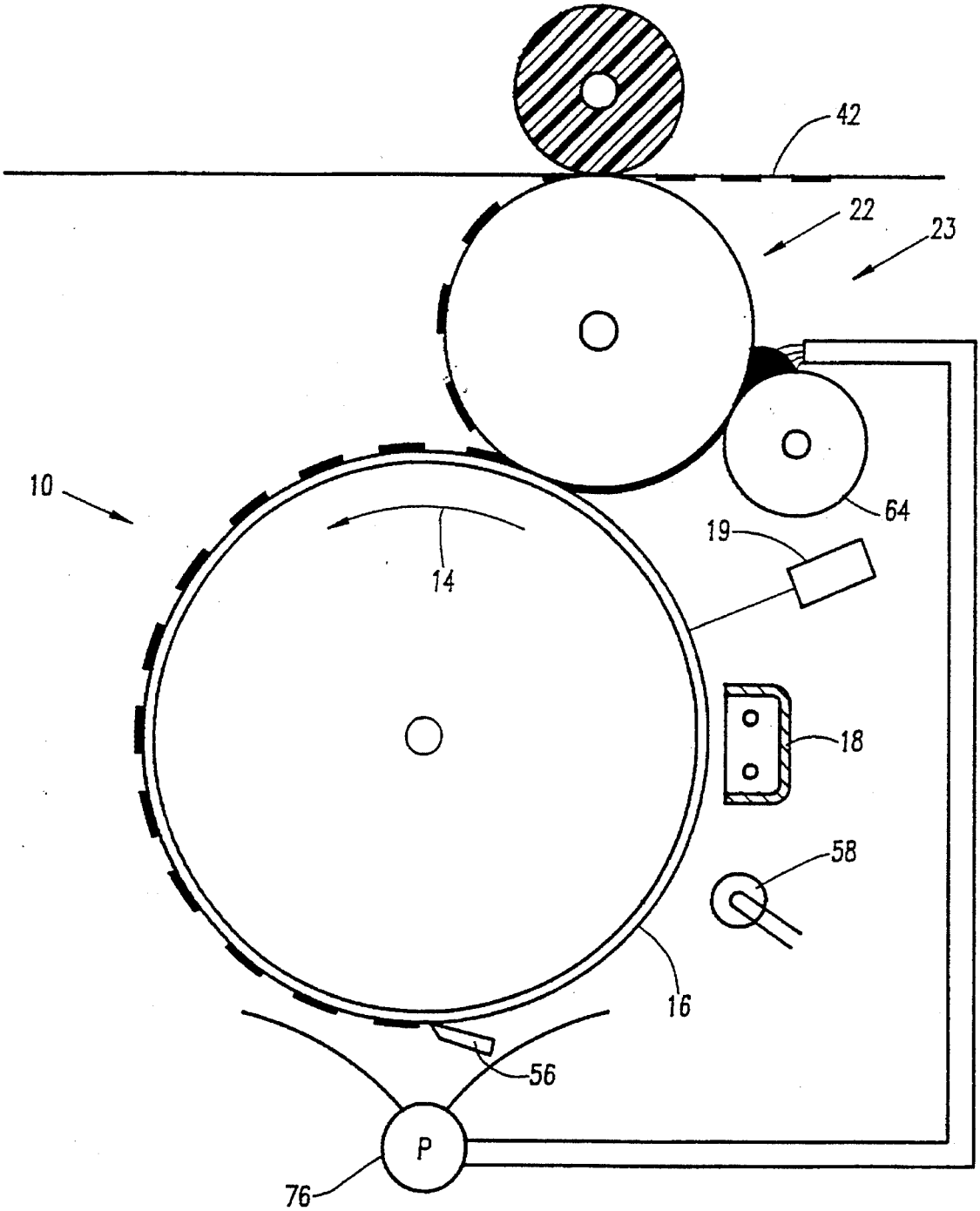
FIG. 5 is a schematic diagram of an further preferred embodiment of the present invention.

Reference is now made to FIG. 5 which shows another embodiment of the apparatus in accordance with the invention. The apparatus of FIG. 5 is similar to that of FIG. 1 except that the apparatus is used for a "reversal" development on roller 22 by the latent image on photoconductive surface 16. In this embodiment, the desired image is formed by the areas of toner concentrate which remain on the surface of developer roller 22 after the development of photoconductive surface 16, and it is developer roller 22 and not drum 10 which is then brought into operative association with an intermediate transfer member (not shown) or a final substrate so as to obtain a print of the desired image. Also shown in FIG. 5 is a pump 76 which is operative to pump back for reuse the toner concentrate which has been removed from photoconductive surface 16 by cleaning station 56 at the conclusion of the imaging cycle. Any of the developer assemblies described above may also be used in the context of this embodiment.

Figure 6:
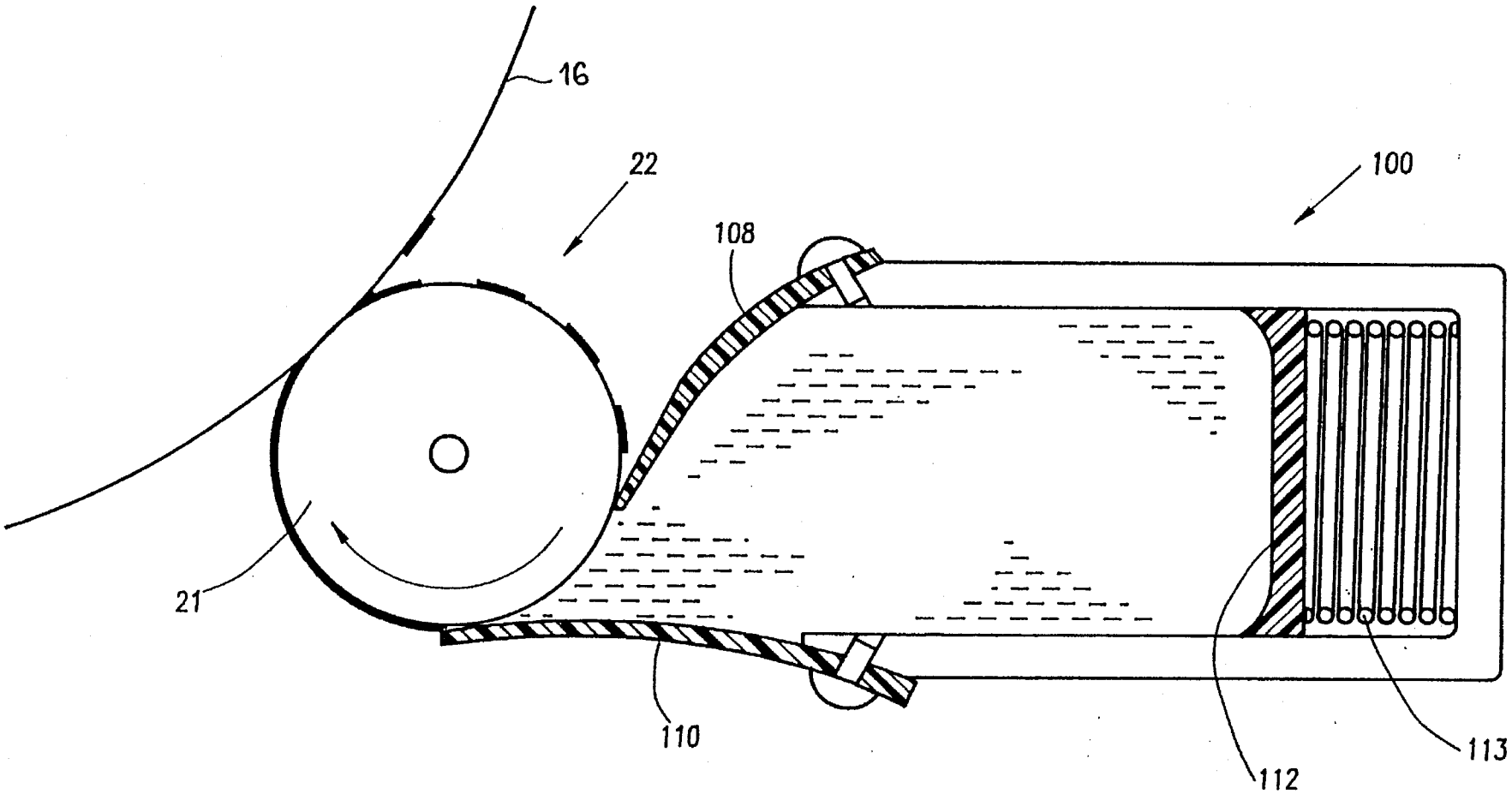
FIG. 6 is a schematic diagram showing toner supply apparatus in accordance with an alternative embodiment of the present invention.

Reference is now made to FIG. 6, which shows an alternative embodiment of a toner supply apparatus in accordance with the invention. The apparatus of FIG. 6 comprises a housing 100 to which arms 108 and 110 are attached. Arms 108 and 110 are adapted to be resiliently urged against surface 21 of developer roller 22. Interior to housing 100 is a piston-like platform 112 which is spring-mounted on the base of housing 100. In operation, housing 100 is filled with liquid toner concentrate which is pushed in the direction of developer roller 22 by the action of a spring 113 on platform 112. Arms 108 and 110 serve to contain the liquid toner concentrate from spilling outward, and arm 110 further functions as a blade to meter the deposition of the required amount of liquid toner on surface 21 of developer roller 22. Arm 110 may also be biased electrically as explained above.

Alternatively, spring 113 may be replaced by a gas-pressure apparatus which is operative to cause dispensing of the liquid toner concentrate by propelling platform 112 in the direction of developer roller 22.

In another embodiment of the invention, housing 100 together with a supply of liquid toner concentrate and roller 22 may be supplied as a disposable unit, being replaced when the supply of liquid toner concentrate is depleted.

Figure 7A:
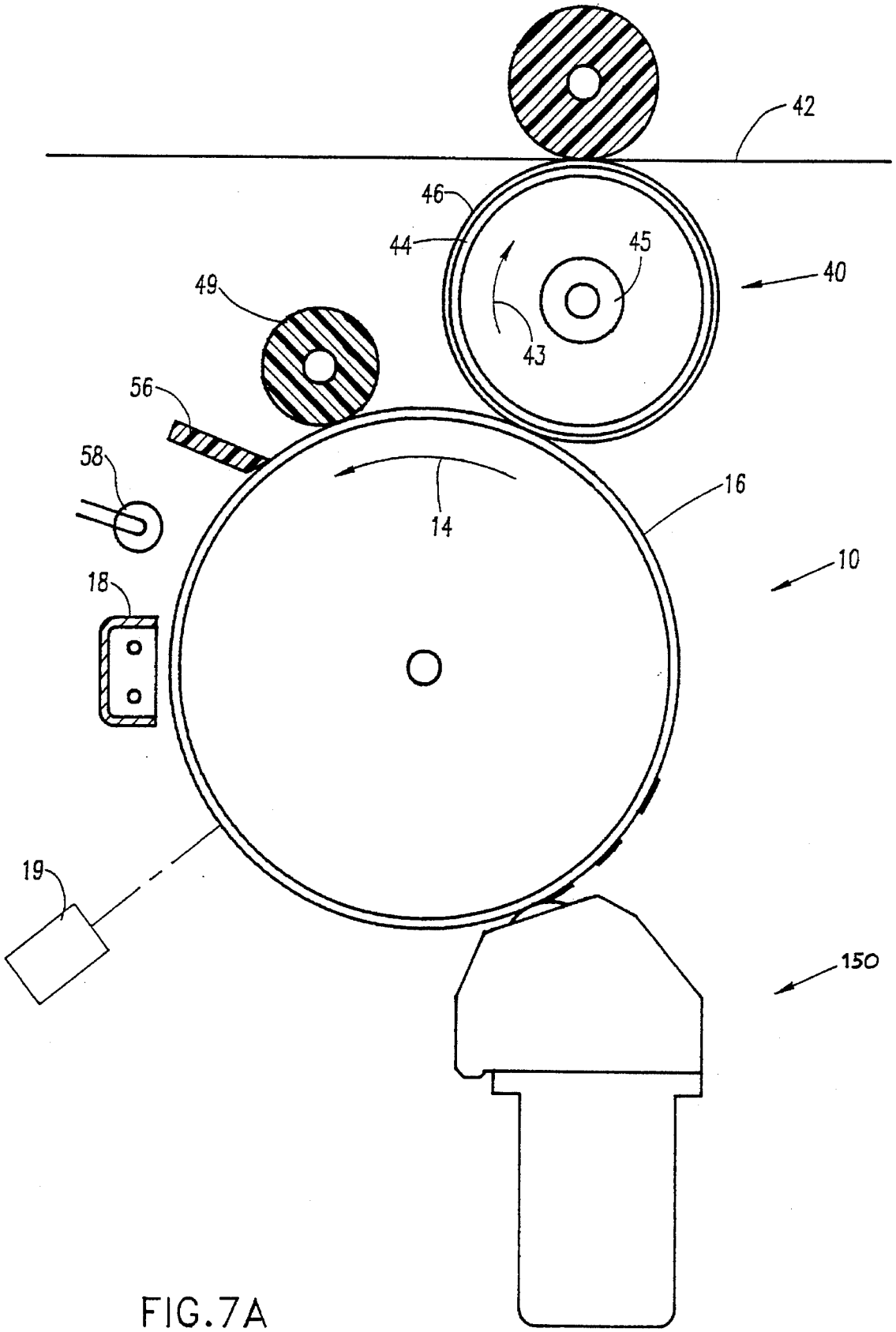
FIGS. 7A and 7B are schematic diagrams of an alternative embodiment of a developer assembly constructed and operated according to the present invention.
Figure 7B:
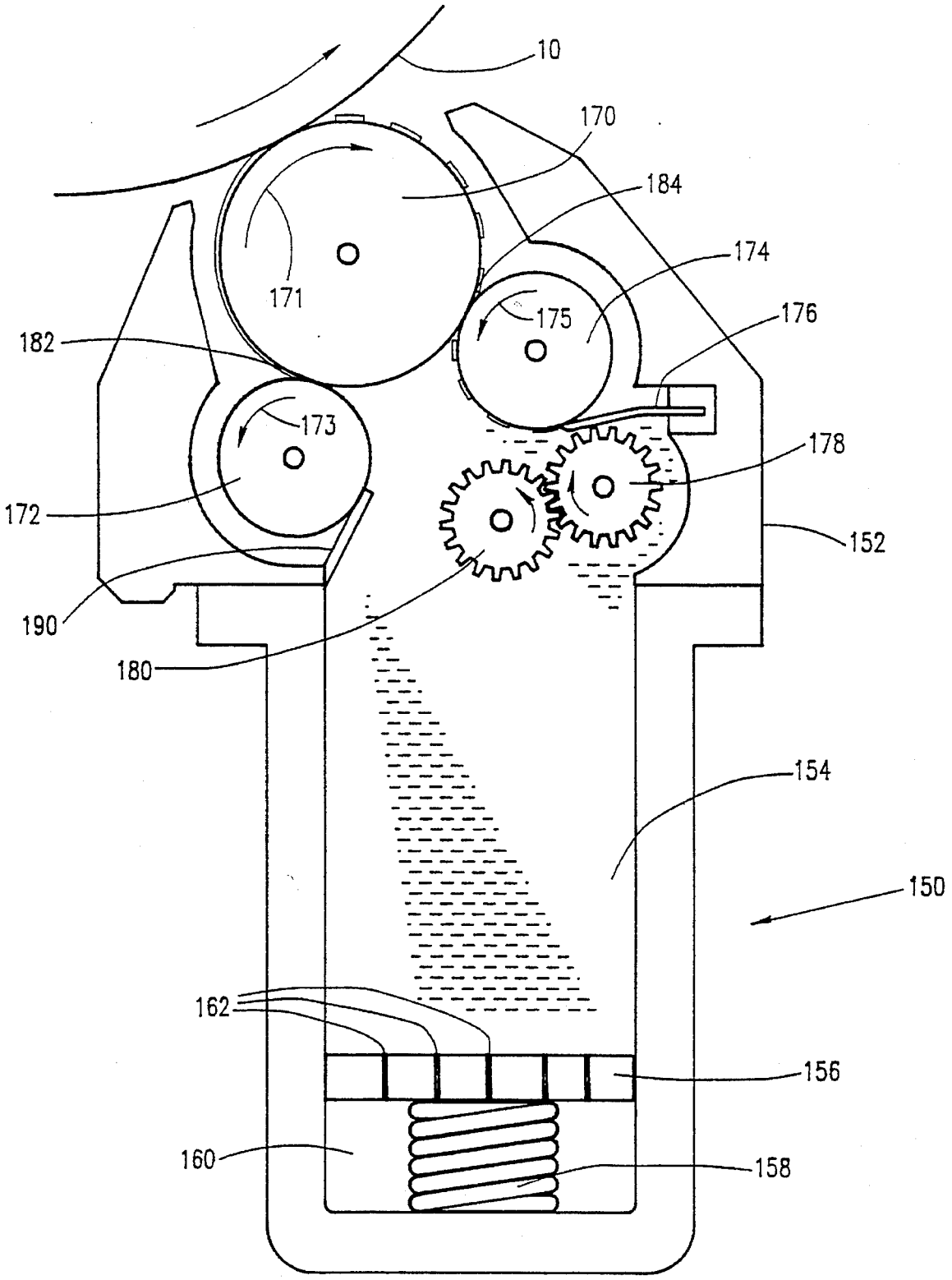

Reference is now made to FIGS. 7A and 7B which show an alternative embodiment of developer assembly 23 in accordance with a preferred embodiment of the invention. In this embodiment, the developer assembly (including the developer roller and associated elements) is not a fixed component within the imaging apparatus itself, but rather takes the form of a replaceable cartridge 150 which can be readily inserted into the casing of the imaging apparatus (not shown) and removed therefrom when the supply of liquid toner concentrate has been depleted. As shown in greater detail in FIG. 7B, cartridge 150 comprises a housing 152 and an internal space 154 containing a supply of liquid toner concentrate. In accordance with a preferred embodiment of the invention, the liquid toner supplied with cartridge 150 contains a relatively high concentration of charged toner particles, on the order of 30%, and carrier liquid. A movable platform 156 is mounted internally to the base of housing 152 by a spring 158, which is at its maximum tension when space 154 is initially filled to its capacity with liquid toner concentrate. The area 160 between housing 152 and movable platform 156 may be packed with any suitable liquid-absorbing material, such as a sponge. Platform 156 contains a network of tiny capillaries 162 through which excess liquid in space 154 may drip into space 160 and be absorbed by the sponge-like material contained therein.

Mounted within housing 152 is a roller 170 which is composed of any suitable electrically conducting material and which has a surface composed of a soft polyurethane material, preferably made more electrically conductive by the inclusion of conducting additives. In a preferred embodiment of the invention roller 170 has a small diameter, desirably less than about 4 cm and preferably about 2.25 cm. The surface of roller 170 protrudes somewhat from the opening of housing 152, such that when cartridge 150 is installed in the imaging apparatus, the surface of roller 170 contacts the photoconductive surface of drum 10. When the apparatus is activated, roller 170 is electrically charged and is caused to rotate in the direction indicated by arrow 171. As is more fully described below, a layer of highly concentrated liquid toner is deposited on the surface of roller 170 which then functions as a developer roller with regard to latent images formed on the photoconductive surface of drum 10, in a manner similar to that described above with regard to other embodiments of the invention.

In addition to roller 170, cartridge 150 comprises two other rollers, 172 and 174, which are mounted within housing 152 such that the surface of roller 172 contacts the surface of roller 170 at point 182 and the surface of roller 174 contacts the surface of roller 172 at point 184. Rollers 172 and 174 are composed of any suitable electrically conducting material. Roller 172 has a diameter which is significantly smaller than that of roller 170. Thus, if roller 170 has a diameter of 2.25 cm., roller 172 has a diameter of 1.5 cm.

When cartridge 150 is installed and the imaging apparatus is in operation, rollers 172 and 174 are electrically charged and are caused to rotate in a direction opposite that of roller 170 (as indicated by arrows 173 and 175), while they are urged against the resilient surface of roller 170.

It is a feature of this embodiment of the invention that the layer deposited on roller 170 has a very high solids concentration of preferably greater than about 40 percent and typically between 50 and 60 percent, when the initial concentration of solids in space 154 is preferably above 25% and typically about 30 percent. This layer of toner has been found to be almost dry to the touch, non-flowing and crumbly in texture. It has also been found that the quality of the developed latent image is enhanced greatly as a result, and no additional drying mechanism is needed when the image is transferred to the final substrate. Since so much liquid has been removed from the layer a thickness of 2–8 micrometers on roller 170 is sufficient.

Because of the relatively small diameters of rollers 170 and 172, a relatively small force of up to 300 gm-force/cm of length applied at the line of contact of rollers 170 and 172 is sufficient. For this force, if negatively charged toner particles are used, roller 170 preferably is charged to an electrical potential which is 150 volts more positive than that of roller 172 and roller 174 is charged to an electrical potential which is 250 volts more positive than roller 170.

It will readily be seen that since interior space 154 of housing 152 is filled with liquid toner concentrate, when the apparatus is activated and rollers 170 and 172 rotate, the interaction between roller 170 and 172 at contact point 182 results in the deposition of a concentrated layer of liquid toner on the surface of roller 170. Then, as roller 170 continues to rotate, it functions in turn as a developer roller with regard to the latent-image-bearing surface of drum 10, with portions of the layer of the dry to the touch liquid toner concentrate being selectively transferred to the surface of drum 10, thereby developing the latent image, as explained above with regard to the other embodiments of the invention. As described above, because of the squeegee action of the resilient surface of roller 170 at contact point 182, a large proportion of the carrier liquid contained within the toner concentrate is squeezed out as the layer of toner is deposited on roller 170.

After portions of the layer of toner concentrate have been transferred to the surface of drum 10 to develop the latent image, the remaining portions of the toner layer on roller 170 continue to rotate on the surface of roller 170 until they reach contact point 184 between roller 170 and roller 174. Then, because of the relative electrical potentials on roller 170 and roller 174, the remaining portions of the toner layer are transferred to roller 174 at contact point 184. Downstream of contact point 184, a resilient blade 176 which is anchored to the internal wall of housing 152, scrapes off the remaining portions of the toner layer from the surface of roller 174.

Because the portions of toner concentrate which are scraped off of roller 174 are dry and crumbly, they will not disperse easily within the liquid toner concentrate remaining in the cartridge. To aid in the dispersion process, a pair of oppositely turning teeth-bearing rods 178 and 180 are mounted within housing 152, such that the portions of dry toner scraped off of roller 174 fall between them and are broken apart by the interaction of the teeth on the rods. The turbulence caused by the rotational movement of rods 178 and 180 also aid in the dispersion of the drier portions of the toner within the solution of toner concentrate.

As the initial supply of toner concentrate contained within space 154 is gradually depleted in the process of developing the latent image, the action of spring 158 causes platform 156 to push the mass of toner concentrate within space 154 in the direction of contact point 182, until space 154 is virtually emptied of toner concentrate. A seal 190 is also provided between housing 152 and roller 172, so as to ensure that liquid toner may not be released from cartridge 150 except as a result of the interaction of roller 170 and roller 172 at contact point 182.

As a consequence of the fact that a large proportion of the carrier liquid contained within the toner concentrate is squeegeed out when the layer of toner is deposited on roller 170, the concentrate still remaining within space 154 is subject to an ongoing process of dilution, as the concentrate is used up. Were this dilution process allowed to continue unchecked, it could result in an unevenness in the liquid content of the toner layers being deposited on roller 170 as the supply of concentrate was being depleted. It is for this reason that the area 160 between housing 152 and movable platform 156 is packed with a sponge-like material and platform 156 is fitted with a network of tiny capillaries 162. Excess carrier liquid in the toner concentrate generated by the squeegee action of rollers 170 and 172 will drain through these capillaries and be absorbed by the sponge-like material, so that at any given time during the life-span of the cartridge, the liquid content of the toner concentrate will remain substantially the same.

The developer assembly described with reference to FIGS. 7A and 7B may be easily adapted for use with the embodiments of FIGS. 1, 2, 4 and 5.

Although a variety of toners are suitable, a preferred toner for the embodiments of FIGS. 7A and 7B is made in the following method:

Compounding 36 grams of Picotoner 1278 (Hercules), a styrene acrylate copolymer, is loaded on a Brabender two-roll mill preheated to 160° C. 30 grams of Mogul-L (Cabot) carbon black are added in small amounts during a period of about 10 minutes while working of the material is continued. 84 grams of Iotec 8030 (EXXON), an acrylic acid ethylene copolymer partial sodium salt, is added during 10 additional minutes of compounding. The material is discharged and after it is cooled to room temperature it is shredded in a granulator and then cryogenically ground in a Retsch centrifugal mill. The resulting material is used in the size reduction step.

Size Reduction 570 grams of powdered material produced by the compounding step is loaded, together with 1330 grams of Norpar-13 (EXXON) in a Union Process size 1S attritor filled with 3/16" carbon steel balls. The material is ground at 20° C. and 200 RPM for 16 hours to a median diameter of 2.6 microns as measured by a Shimadzu particle size analyzer. The resulting material is screened through a 300 micrometer sieve to remove large particles.

The resulting toner concentrate is charged with charge director as is known in the art. A variety of charge directors known in the art are operative in this embodiment of the invention. A preferred charge director is Lubrizol 890 (Lubrizol Corporation).

Alternatively, the carrier liquid is at least partially replaced by a grease or petrolatum. This material has a high viscosity and is thixotropic, thereby reducing leaks.

It will be appreciated by persons skilled in the art that the present invention is not limited to what has been particularly shown and described hereinabove. Rather, the scope of the present invention is defined only by the claims that follow:

We claim:

1. An imaging method comprising the steps of:

forming a latent electrostatic image including image regions at a first voltage and background regions at a second voltage on a first surface of a first member;

charging a second member having a second surface adapted for operative engagement with the first surface at a first, development, region to a third voltage intermediate the first and second voltages;

resiliently urging a third member against the second surface at a second region;

supplying liquid toner comprising charged toner particles and carrier liquid to the second region and forming a thin layer of liquid toner containing a concentration of charged toner particles greater than 15% on the second surface, said thin layer being of sufficient thickness to substantially fill the space between the first and second members;

developing the latent image by the selective transfer of portions of the layer of liquid toner from the second surface to the first surface at the first region to form a developed image on the first member; and transferring the developed image from the first member to a final substrate.

2. A method according to claim 1 wherein the liquid toner supplied to the second region comprises less than 35% charged toner particles.

3. A method according to claim 2 wherein the concentration of toner particles in the liquid toner supplied to the second region is substantially the same as in the thin layer of liquid toner.

4. A method according to claim 1 wherein the concentration of toner particles in the liquid toner supplied to the second region is substantially the same as in the thin layer of liquid toner.

5. A method apparatus according to claim 1 wherein the concentration of toner particles in the liquid toner supplied to the second region is substantially less than in the thin layer of liquid toner.

6. A method according to claim 1 wherein the thin layer of liquid toner comprises more than 20% charged toner particles.

7. A method according claim 1 wherein the layer of liquid toner is crumbly in texture and almost dry to the touch.

8. A method according to claim 1 wherein the thin layer of liquid toner has a concentration of toner particles greater than 40 percent.

9. A method according to claim 8 wherein the thin layer of liquid toner has a concentration of toner particles greater than 50 percent.

10. A method according to claim 1 wherein the layer of liquid toner comprises less than 35% charged toner particles.

11. A method according to claim 1 wherein the layer of liquid toner has a thickness between 2 and 8 micrometers.

12. A method according to claim 1 wherein the thin layer has a thickness between 5 and 15 micrometers.

13. A method according to claim 1 wherein at least one of the first and second surfaces is formed of a resilient material.

14. An imaging method comprising the steps of:

forming a latent electrostatic image including image regions at a first voltage and background regions at a second voltage on a first surface of a first member;

charging a second surface of a second member to a third voltage intermediate the first and second voltages;

resiliently urging the second surface against the first surface;

depositing on the surface of the second member a thin layer of liquid toner containing a concentration of charged toner particles greater than 15%, said thin layer being of sufficient thickness to substantially fill the space between the first and second members;

forming a desired image by selectively transferring portions of the layer of liquid toner from the surface of the second member to the first surface of the first member, the portions remaining on the surface of the second member constituting the desired image; and transferring the desired image to a final substrate.

15. A method according to claim 14 wherein the thin layer of liquid toner comprises more than 20% charged toner particles.

16. A method according to claim 14 wherein the layer of liquid toner is crumbly in texture and almost dry to the touch.

17. A method according to claim 14 wherein the layer of liquid toner has a thickness between 2 and 8 micrometers.

18. A method according to claim 14 wherein the thin layer has a thickness between 5 and 15 micrometers.

19. A method according to claim 14 wherein at least one of the first and second surfaces is formed of a resilient material.

20. Imaging apparatus comprising:

a first member including a first surface having formed thereon a latent electrostatic image, the latent electrostatic image having image regions at a first voltage and background regions at a second voltage;

a second member charged to a third voltage intermediate the first and second voltages and having a second surface adapted for resilient engagement with the first surface;

a third member adapted for depositing on the surface of the second member a thin layer of liquid toner containing a concentration of charged toner particles greater than 15%, said thin layer being of sufficient thickness to substantially fill the space between the first and second members;

means for obtaining a desired image by selectively transferring portions of the layer of liquid toner from the surface of the second member to the photoconductive surface of the first member, the portions remaining on the surface of the second member constituting the desired image; and means for transferring the desired image to a final substrate.

21. Imaging apparatus according to claim 20 wherein the thin layer of liquid toner comprises more than 20% charged toner particles.

22. Imaging apparatus according claim 20 wherein the layer of liquid toner is crumbly in texture and almost dry to the touch.

23. Imaging apparatus according to claim 20 wherein the thin layer of liquid toner has a concentration of toner particles greater than 40 percent.

24. Imaging apparatus according to claim 20 wherein the thin layer of liquid toner has a concentration of toner particles greater than 50 percent.

25. Imaging apparatus according to claim 20 wherein the layer of liquid toner comprises less than 35% charged toner particles.

26. Imaging apparatus according to claim 20 wherein the layer of liquid toner has a thickness between 2 and 8 micrometers.

27. Imaging apparatus according to claim 20 wherein the thin layer has a thickness between 5 and 15 micrometers.

28. Imaging apparatus according to claim 20 wherein at least one of the first and second surfaces is formed of a resilient material.

29. Imaging apparatus according to claim 20 wherein the third member is a roller with an elastomer surface.

30. Imaging apparatus according to claim 20 wherein the third member is a resilient blade.

31. Imaging apparatus according to claim 20 wherein the third member is a spring-mounted wire-wrapped solid rod.

32. Imaging apparatus according to claim 20 wherein the third member comprises a metallic-screen hollow drum containing liquid toner and a squeegee blade urged against the inner surface of the metallic-screen.

33. Imaging apparatus according to claim 32 wherein the metallic-screen hollow drum containing liquid toner and a squeegee blade form a single disposable unit.

34. Imaging apparatus according to claim 20 including a doctor blade in engagement with the second surface.

* * * * *